United States Patent [19]

Nakata

[11] Patent Number: 4,825,343

[45] Date of Patent: Apr. 25, 1989

[54] PROJECTOR TYPE HEADLAMP FOR VEHICLES

[75] Inventor: Yutaka Nakata, Isehara, Japan

[73] Assignee: Ichikoh Industries Limited, Tokyo, Japan

[21] Appl. No.: 72,972

[22] PCT Filed: Dec. 23, 1986

[86] PCT No.: PCT/JP86/00653

§ 371 Date: Jun. 23, 1987

§ 102(e) Date: Jun. 23, 1987

[87] PCT Pub. No.: WO87/04229

PCT Pub. Date: Jul. 16, 1987

[30] Foreign Application Priority Data

| | | | |
|---|---|---|---|
| Dec. 27, 1985 | [JP] | Japan | 60-292950 |
| Feb. 10, 1986 | [JP] | Japan | 61-25971 |
| Feb. 10, 1986 | [JP] | Japan | 61-25972 |
| Feb. 10, 1986 | [JP] | Japan | 61-25973 |
| Feb. 18, 1986 | [JP] | Japan | 61-31935 |

[51] Int. Cl.[4] ..... K21V 7/00

[52] U.S. Cl. ..... 362/61; 362/348; 362/346; 362/307; 362/308

[58] Field of Search ..... 362/61, 80, 327, 328, 362/297, 298, 299, 301, 303, 305, 346, 348, 268, 307, 308, 311, 296

[56] References Cited

U.S. PATENT DOCUMENTS

| | | | |
|---|---|---|---|
| 3,930,149 | 12/1975 | French | 362/308 |
| 4,511,955 | 4/1985 | Ernst et al. | 362/347 |
| 4,517,630 | 5/1985 | Dieffenbach et al. | 362/347 |
| 4,562,519 | 12/1985 | Deres | 362/308 |
| 4,669,032 | 5/1987 | Lietar et al. | 362/61 |
| 4,686,610 | 8/1987 | Cibie et al. | 362/61 |
| 4,771,372 | 9/1988 | Litetar et al. | 362/307 |
| 4,772,987 | 9/1988 | Kretschner et al. | 362/346 |
| 4,779,179 | 10/1988 | Ogama et al. | 362/348 |

FOREIGN PATENT DOCUMENTS

| | | | |
|---|---|---|---|
| 0210406 | 2/1987 | European Pat. Off. | 362/297 |
| 0000519 | 8/1979 | France | 362/346 |
| 51-145791 | 5/1950 | Japan . | |
| 8704229 | 7/1979 | Japan | 362/346 |
| 59-158003 | 9/1984 | Japan . | |
| 59-163702 | 9/1984 | Japan . | |
| 59-212803 | 12/1984 | Japan . | |
| 60-119001 | 6/1985 | Japan . | |

*Primary Examiner*—Ira S. Lazarus
*Assistant Examiner*—D. M. Cox
*Attorney, Agent, or Firm*—Foley & Lardner, Schwartz, Jeffery, Schwaab, Mack, Blumenthal & Evans

[57] ABSTRACT

A projector type headlamp in which the reflecting surface of a reflector is not the surface geometically decided but composed of a great many minute face elements smoothly connected with each other and the orientation of each face element with respect to the optical axis is decided such that the light incident from a light source is reflected to the vicinity of a meridional image plane of a convex lens and a desired luminosity distribution can be obtained at the position of a shade. According to the headlamp, it is possible to control a distribution pattern so as to have a desired luminosity distribution and to utilize the light emitted from the light source effectively.

15 Claims, 16 Drawing Sheets

PROJECTOR TYPE HEADLAMP FOR VEHICLES

TECHNICAL FIELD

The present invention relates to a projector type headlamp for vehicles in which a predetermined beam formation is reflected by an reflector through a shutter or shade and further projected by using a convex lens.

BACKGROUND OF THE ART

It has been necessary for the headlamp for vehicles, particularly automobiles to have a distribution pattern such that the lane of travel is brightly illuminated without dazzling drivers of the automobiles running in the opposite lane. There has been proposed a so-called projector type headlamp as a headlamp having the distribution pattern satisfying such requirement mentioned above, a simple lens arrangement, and a compact size. For example, U.S. Pat. No. 4,511,955 discloses the headlamp of such type in which the reflecting surface of the reflector is formed in a revolutional ellipse and the luminosity distribution of a pattern is dependent on the formation of the reflector even though a particular distribution pattern can be obtained. Namely, it is possible to change the luminosity distribution of the distribution pattern in a constant range by changing the eccentricity of the ellipse, however it is the luminosity distribution inherent in an ellipse and it has a constant similarity. Therefore, the luminosity distribution of the distribution pattern is generally decided by the formation (a revolutional ellipse surface, a revolutional parabolic surface) of the reflector's surface, so that there is no sufficient freedom in design for obtaining a desired luminosity distribution. The object of the present invention is to present a novel headlamp of the projector type in which the above-mentioned drawbacks of the conventional headlamp of the projector type is eliminated.

The other object of the present invention is to present a headlamp in which the reflecting surface of the reflector is composed of a great many minute face elements connected with each other continuously and smoothly, the orientation of each face element is different from each other so as to obtain a desired luminosity distribution, and it is setable voluntarily to a distribution pattern having a desired luminosity distribution.

Still the other object of the present invention is to present a projector type headlamp in which the orientation of each face element is decided such that the maximum luminosity region in the distribution pattern is substantially not affected with any influence by a shade for providing a light-dark boundary.

DISCLOSURE OF THE INVENTION

The reflecting surface of the reflector of the projector type headlamp of the present invention is not the surface decided by a geometrical surface such as a revolutional ellipse surface and a revolutional parabolic surface, but is composed of a great many minute face elements connected with each other continuously and smoothly, the orientation of each face element is previously decided such that the light incident from a light source is reflected toward the vicinity of the meridional image plane of the lens and a predetermined luminosity distribution can be obtained at the position of the shade. By this the distribution pattern having a desired luminosity distribution can be obtained voluntarily.

The orientation of the face element with respect to an optical axis can be decided such that the light incident from the light source is reflected to the vicinity of the meridional image plane of the convex lens and the distance between the optical axis and the point at which the reflected light from each face element is reached on the meridional image plane, can be obtained as a function of a distance between each face element and the plane substantially perpendicular to the meridional image plane and including the optical axis. By selecting the function suitably, it is possible to increase the luminous intensity of the central portion, and to increase the solid angle, and further to increase the meridional luminous intensity, thereby effectively utilizing the reflected light.

Furthermore, it is also possible to decide the orientation of each face element to the optical axis such that the incident light from the light source is reflected toward the vicinity of the meridional image plane of the lens, and then the maximum luminosity region can be formed at the upper portion of the shade's edge. Therefore, the reflected light can be utilized to the maximum extent, since the maximum luminosity region of the distribution pattern is not blocked substantially by the shade's edge for providing the light-dark boundary.

BRIEF DESCRIPTION OF THE DRAWINGS

FIGS. 1 to 15 show a first embodiment of the projector type headlamp of the present invention, in which FIG. 1 is a side view schematically showing the construction of the headlamp, FIG. 2 is a plane view of the same, FIG. 3 is a front view of the same, FIGS. 4 and 5 are views for explaining the optical characteristic of the reflector of the present invention, FIG. 6 is a schematic front view showing the arrangement of the reflecting surface of an reflector composed of a plurality of face elements, FIG. 7 is a schematic enlarged view showing a quarter of the reflecting surface of the reflector shown in FIG. 6, FIG. 8 is a view showing the function $X_s=0.5X_n$ for deciding the luminosity distribution, FIG. 9 is a view for explaining the optical characteristic of each face element by using the function of FIG. 8, FIG. 10 is a schematic view for showing the distribution pattern, FIG. 11 is a schematic view showing the luminosity distribution of the distribution pattern, FIG. 12 is a view for explaining the optical characteristic of each face element in the case where the function for deciding the luminosity distribution is set to $X_s=0.125X_n^2$, FIG. 13 is a schematic view showing the luminosity distribution in the case of $X_s=0.125X_n^2$, FIG. 14 is a schematic view showing distribution pattern in the position of a shade and FIG. 15 is a schematic view showing the distribution pattern in the position from a light source by 10 meter, FIGS. 17 to 19 are views showing a second embodiment of the projector type headlamp of the present invention, in which FIG. 17 is a view for explaining the optical characteristic of the reflector, FIG. 18 is a schematic front view showing the arrangement of each face element composing the reflector's surface and FIG. 19 is a schematic view showing luminosity distribution, FIGS. 20 and 21 are views showing a third embodiment of the projector type headlamp of the present invention, in which FIG. 20 is a view for explaining the optical characteristic of the reflector and FIG. 21 is a schematic front view showing the arrangement of each face element composing the reflecting surface of the reflector, FIGS. 22 and 23 are views showing a fourth embodiment of the projector type headlamp of the present invention, in which FIG. 22 is a view for explaining the optical characteristic of the reflector and FIG. 23 is a schematic front view showing the arrangement of each face element composing the reflecting surface of the reflector, FIGS. 24 and 25 are a fifth embodiment showing the projector type headlamp of the present invention, in which FIG. 24 is a schematic view for showing the distribution pattern on the shade showing the positional relationship between the maximum luminosity region and the shade's edge and FIG. 25 is a schematic view for showing the distribution pattern at the position apart from light source by 10 m.

BEST MODE FOR CARRYING OUT THE INVENTION

Figure 1:
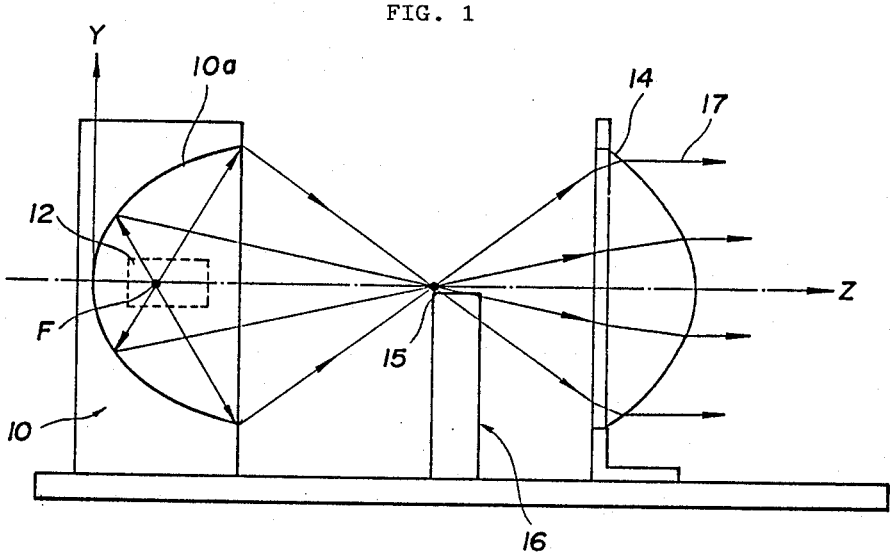
Figure 2:
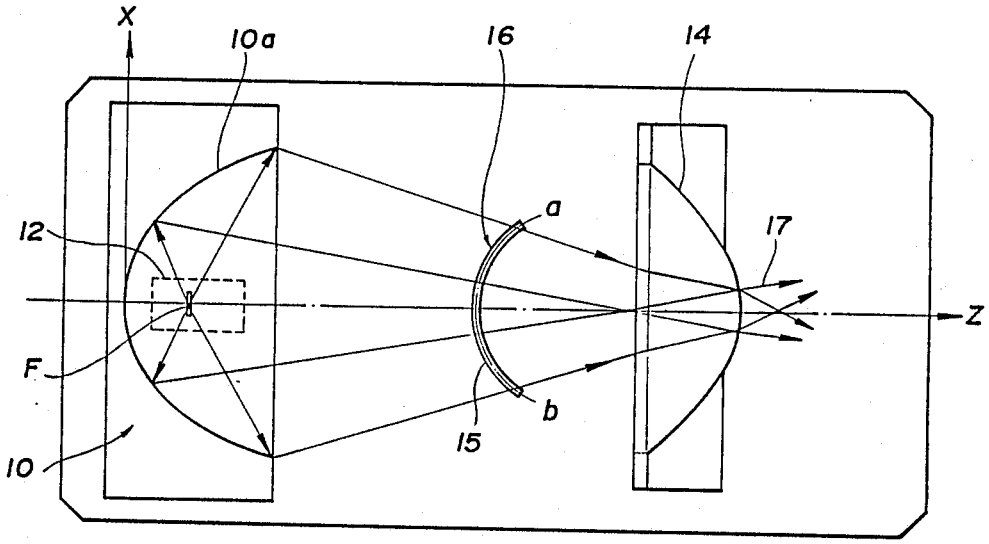

The embodiments of the projector type headlamp of the present invention will be explained hereinafter. FIGS. 1 to 15 show a first embodiment of the present invention. In the figures, numeral 10 denotes a reflector formed in a concave mirror but not formed in a particular curved surface such as a revolutional parabolic surface and a revolutional ellipse surface. The center axis of the reflector 10 is on Z axis as shown in FIG. 1, and the optical axis of a convex lens 14 is aligned with the center axis of the reflector 10. Numeral 12 denotes a halogen bulb including a filament F as a light source, and the center of the filament F is arranged to be on the Z axis and in parallel with the X axis. A shade 16 is disposed between the reflector 10 and the convex lens 14, and the edge 15 positioned at the topmost end thereof is disposed at the vicinity of a meridional image plane a-b of the convex lens 14. Actually, the meridional image plane is a portion of an approximate sphere, and the curve indicated as a-b in FIG. 2 shows a cross-line between the horizontal plane (X-Z plane) including the optical axis and the approximate sphere.

Figure 3:
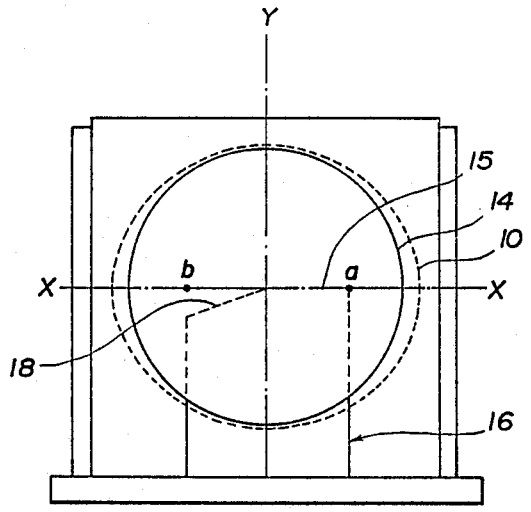

The reflecting surface 10*a* of the above-mentioned reflector 10 is adapted to reflect the light beam coming from the light source F to the meridional plane a-b of the convex lens 14. As shown in FIG. 3, the shade 16 has an edge 18 slanted such that the edge is apart away from the meridional image plane a-b located on the X-Z plane, and the edge 18 is arranged to pass through a portion of the light directed to the downward direction out of the light reflected on the reflecting surface 10*a*. The light beam passing the shade 16 is condensed by the convex lens 14 as mentioned hereinafter and emitted forwardly.

The reflecting surface 10*a* of the reflector 10 according to the present invention is not a geometrically determined curved surface such as a revolutional ellipse surface and a revolutional parabolic surface, but composed of a plurality of minute face elements for reflecting the light beam coming from the light source to a predetermined portion or a predetermined point apart from the light source. It's detail will be explained specifically hereinafter.

Figure 4:
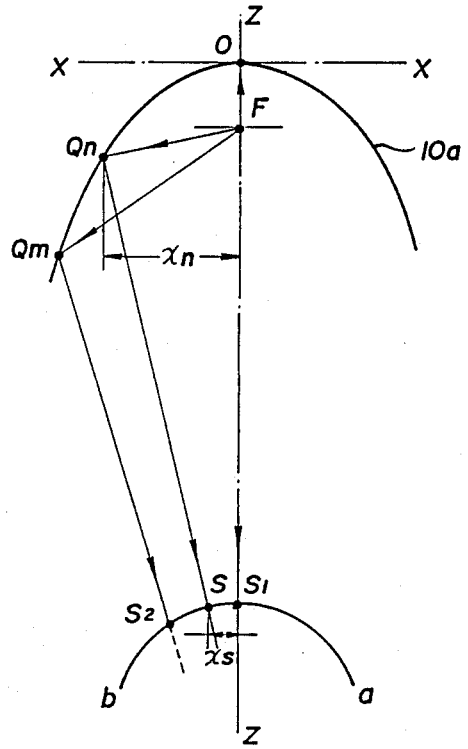
Figure 5:
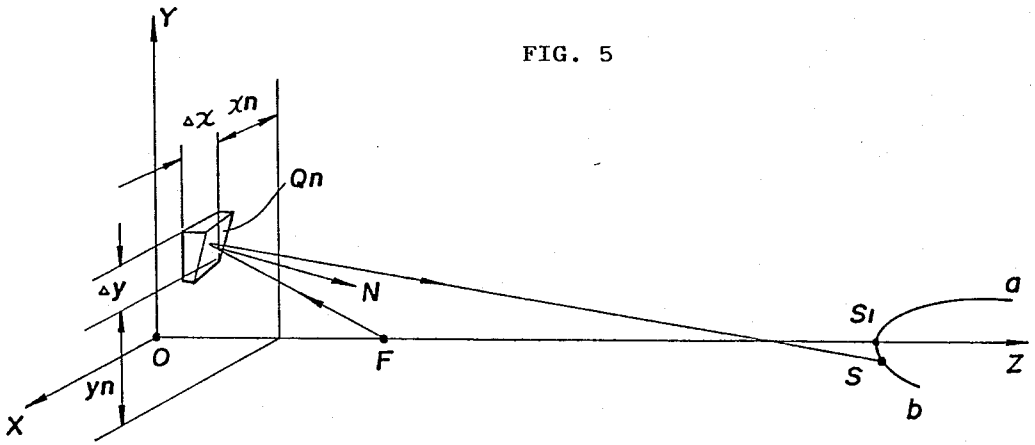
Figure 6:
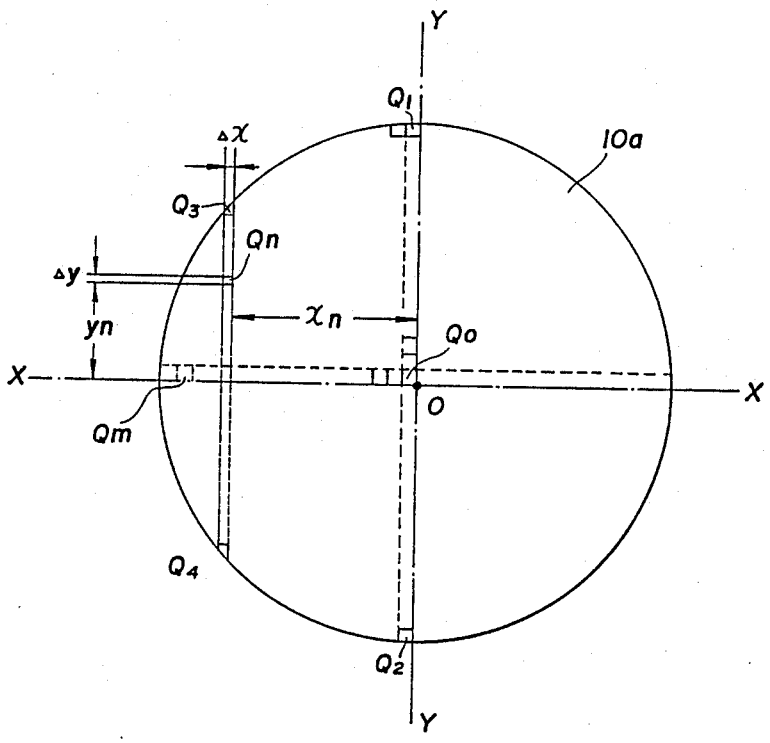
Figure 7:
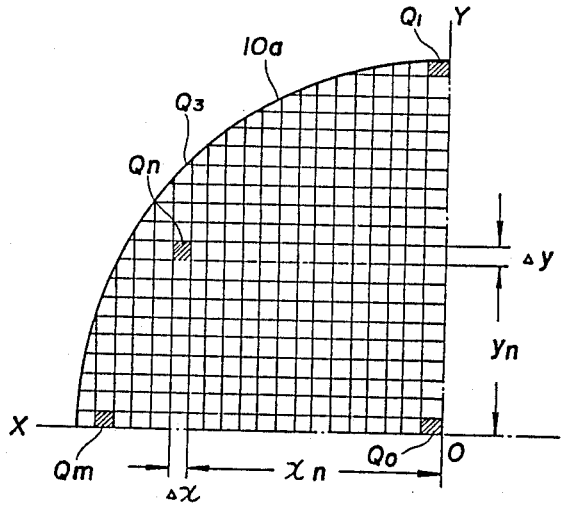

Referring to FIG. 4 there is schematically shown a profile of the portion at which the reflecting surface 10*a* of the reflector 10 crosses the X-Z plane, where X, Y and Z axes denote horizontal, vertical and the center axes of the reflector 10 respectively. The light source F is disposed on the Z axis apart from the center 0 of the reflector 10 with a predetermined distance, and the orientation N of a face element $Q_n$ is decided such that the light reflected on the face element $Q_n$ of the reflecting surface 10*a* is directed to the point S on the meridional image plane a-b of the convex lens 14 as three-dimensionally shown in FIG. 5. Similarly, the light reflected on the face element located on the center O of the reflecting surface 10*a* is directed to the point $S_1$ on the meridional image plane a-b through the light source F, and the light reflected on other face element $Q_m$ apart from the face element $Q_n$ is directed to the point $S_2$ on the meridional image plane. As mentioned above, the orientation of each of face elements $Q_n$ and $Q_m$ is decided. FIG. 6 schematically shows the arrangement of the face elements in view of the Z axis, FIG. 7 shows the quarter portion in FIG. 6 in an enlarged scale. Each face element has a minute region $\Delta S$ having the area of $\Delta X \cdot \Delta Y$ ($\Delta x = \Delta y = 0.2$mm and $\Delta S = 0.4$mm$^2$ in this embodiment), and a minute face element $Q_0$ is disposed at the position corresponding to the center O. At the position corresponding to $X=0$, there are continuously disposed many face elements from $Q_0$ to $Q_1$ in the possitive direction of Y axis except the face element $Q_0$, further to $Q_2$ in the negative direction. The orientation of each of face elements group as shown by these $Q_1$—$Q_0$—$Q_2$ is actually and sequentially decided on the basis of the face element $Q_0$, and the orientation of each face element is decided such that all of the light beams reflected on the face elements is concentrated to the point $S_1$ on the meridional image plane crossing the optical axis.

On the basis of the orientation of each face element group $Q_1$—$Q_0$—$Q_2$, the orientation of each of the face element groups ($\pm\Delta x$) adjacent to the face element group is decided, and the light reflected on the face element corresponding to $x=+\Delta x$ and the light reflected on the face element corresponding to $x=-\Delta x$ are respectively concentrated at different points on the meridional image plane apart from each other by a predetermined distance between positions in the minus and plus directions respectively. Each orientation of each face element is thus decided, and all lights reflected on the face element group $Q_3$—$Q_n$—$Q_4$ on the position $X=-X_n$ having the distance $X_n$ from the center O is concentrated at point S on the meridional image plane having the distance $X_3$ from the optical axis. (In the figure a portion of the face element group corresponding to $X=+X_n$ is omitted for the sake of simplicity.) Furthermore, the light reflected on the face element group including the face element $Q_m$ apart from the optical axis is adapted to be concentrated at the point $S_2$ on the meridional image plane having large distance from the optical axis than the point $X_s$.

The relationship between the above-mentioned $X_n$ and $X_s$ is decided by how the desired luminosity distribution L along the meridional image plane a-b is set.

For example, $X_s$ can be expressed as a function of $X_n$ as follows.

$$X_s = f(X_n) \ldots \quad (1)$$

The function $f(X_n)$ may be considered in several ways such as a first order linear function, a second order linear function, a high order linear function or an exponential function, and further the function $f(X_n)$ may be the conbination thereof.

For example, $$\text{if } f(X_n)=0.5X_n, \ldots \quad (2)$$

Figure 8:
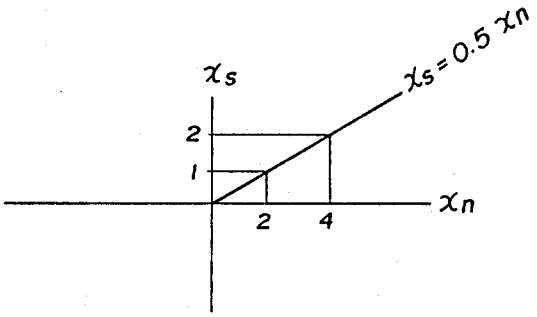
Figure 9:
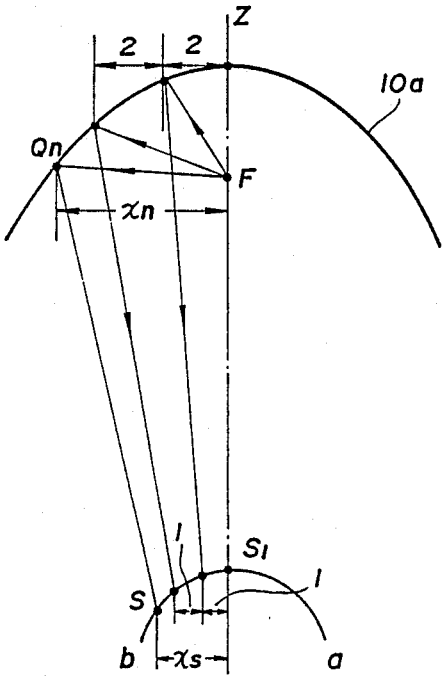

$X_3$ becomes $X_s=0.5X_n$ (FIG. 8). In this case, when $X_s=1$ and when $X_n=4$, $X_s$ becomes 2. In the reflector 10, the lights reflected on the face elements located at the region $-2 \leqq X_n \leqq 2$ are concentrated at the region $-1 \leqq X_s \leqq 1$ on the meridional image plane, similarly the lights reflected by the regions $2 \leqq X_n \leqq 4$ and $-4 \leqq X_n \leqq -2$ are concentrated at the region $1 \leqq X_s \leqq 2$ and $-2 \leqq X_s \leqq -1$ on the meridional image plane respectively.

Figure 10:
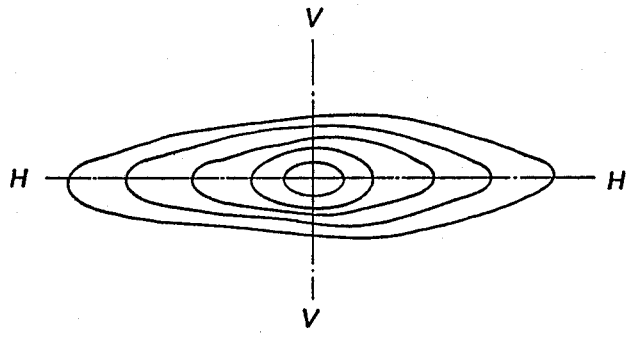
Figure 11:
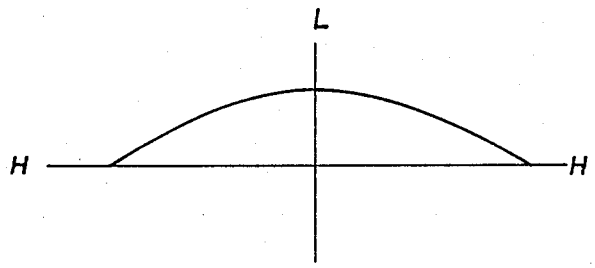

Referring to FIG. 10, distribution pattern on a test screen provided at the vicinity of the meridional image plane is schematically shown as an equiillumination, and the luminosity distribution at that time is shown in FIG. 11. Where the lines H—H and V—V show the horizontal and vertical direction of the screen respectively.

Figure 13:
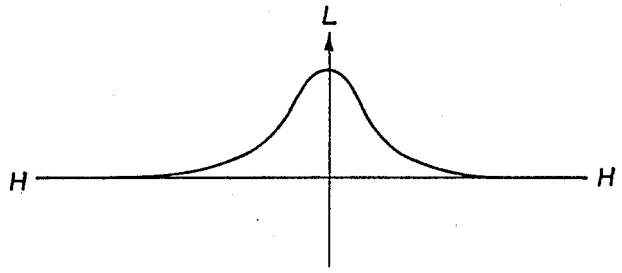
Figure 12:
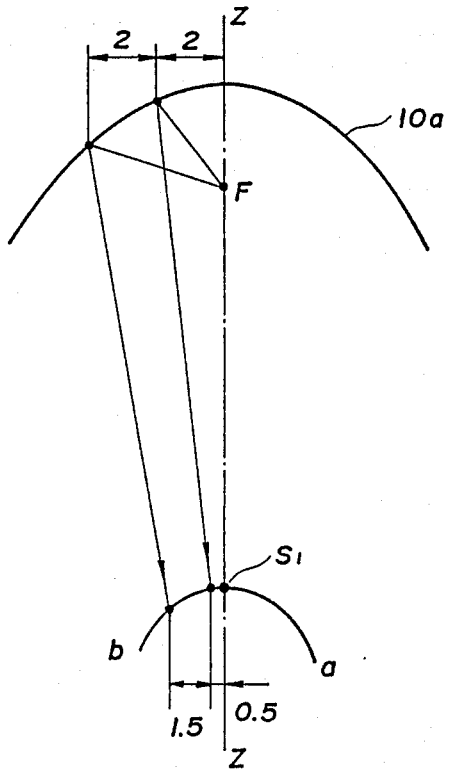

In a normal condition for the headlamp for automobiles, the luminosity distribution as shown in FIG. 11 is insufficient, and it is desirable that a high luminosity is obtained at the central portion. Then, if $f(X_n)=0.125X_n^2$ is used, the lights reflected on the face elements at the region $-2 \leqq X \leqq 2$ at the reflector 10 are concentrated at the region $-0.5 \leqq X_s \leqq 0.5$ of the meridional image plane as shown in FIG. 12, and this is higher at the central luminosity than the case of $X_s=0.5X_n^2$. The luminosity distribution L shown by a solid line in FIG. 13 is corresponding to the case of $X_s=0.125X_n^2$.

In order to further increase the central luminosity, it is possible to express $X_s$ by a high-order linear function of $X_n$ and further an exponential function of $X_n$, therefore a suitable function may be used for obtaining a desired distribution characteristic. In this selection of the function, several luminosity distribution characteristics may be without any limitation due to the above examples within the mode that the maximum luminosity can be obtained at the central portion and the luminosity is symetrically reduced in the right and left directions as it is apart from the center. The work for forming each face element having a different orientation as mentioned above is effected by an NC working machine.

Figure 14:
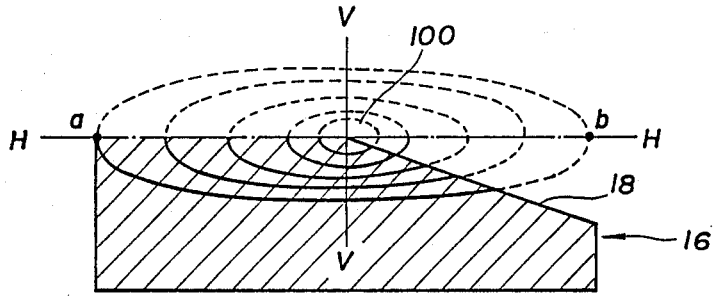
Figure 15:
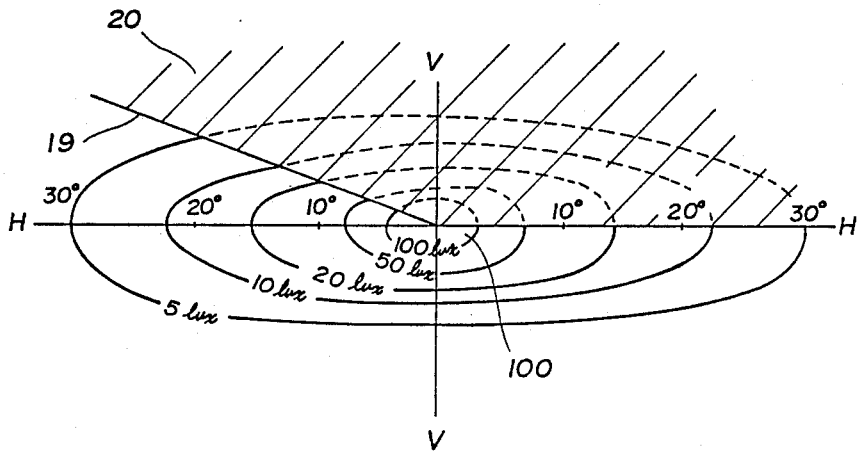

The light reflected on each face element of the reflector 10 formed so as to obtain the center luminosity suitable as mentioned above is projected by the convex lens 14 in the condition that a portion of the light is blocked by the shade 16 having the upper edge at the vicinity of the meridional image plane a-b. Namely, as shown in FIG. 14, the upper half of the pencil passes through the above the edge portion 15 of the shade 16 and most of the lower half is blocked by the shade 16 as shown by the solid line, and the light beam located above the slanted end portion 18 is allowed to pass as shown dotted by the lines. Numeral 100 denotes the maximum luminosity region. The pencil projected forwardly by the convex lens 14 has a pattern inverted from the pattern as shown by the dotted lines in FIG. 14. Referring to FIG. 15, there is shown the equiillumination curve of the distribution pattern, when the screen is disposed at the position apart from the light source F by 10 meters and a halogen bulb of H3 12 V/55 W in EC standard is used as the light source F. The oblique lines 20 denote the light portion blocked by the shade 16 and the edge provided a light-dark boundary 19 to the pencil 17 formed by the convex lens 14.

Figure 16:
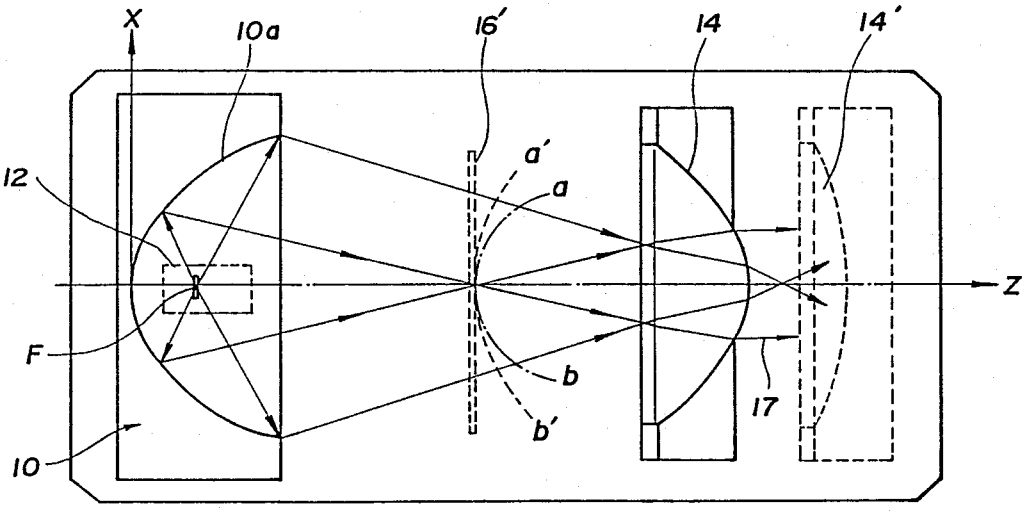
FIG. 16 is a schematic side view showing a headlamp using a plate-like shade.

In this embodiment, the orientation of each face element of the reflector is decoded such that all lights reflected on each face element are directed to the point on the meridional image plane a-b of the convex lens 14, but it may be possible to set the orientation of each face element such that each reflected light is directed to a point disposed between the meridional image plane and the sagittal image plane of the lens 14. Furthermore, it is also possible to form a shade as shown by the dotted line 16' in FIG. 16 as a plate perpendicular to the optical axis, and in this case the convex lens 14' having a curvature larger than the convex lens in the first embodiment may be used and the convex lens 14' may be disposed such that the plate 16' is in contact with the meridional image plane a'-b'. By this, a similar effect can be expected within the actually required torelance in comparison with the above-mentioned embodiment in which the shade is curved along the meridional image plane a-b of the convex lens.

Figure 17:
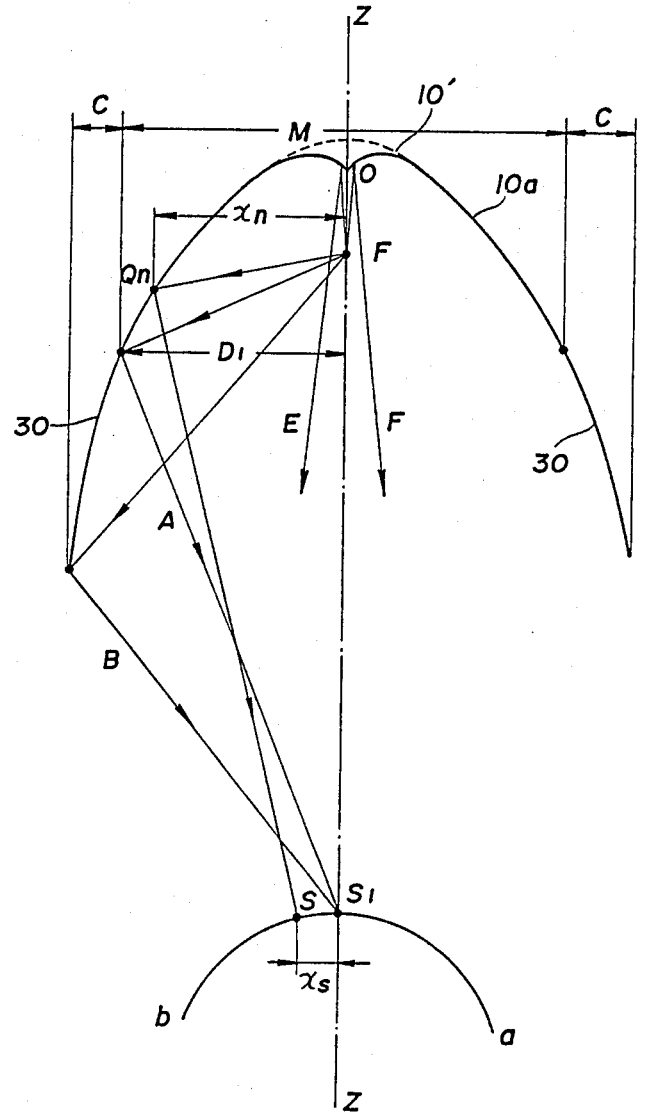
Figure 18:
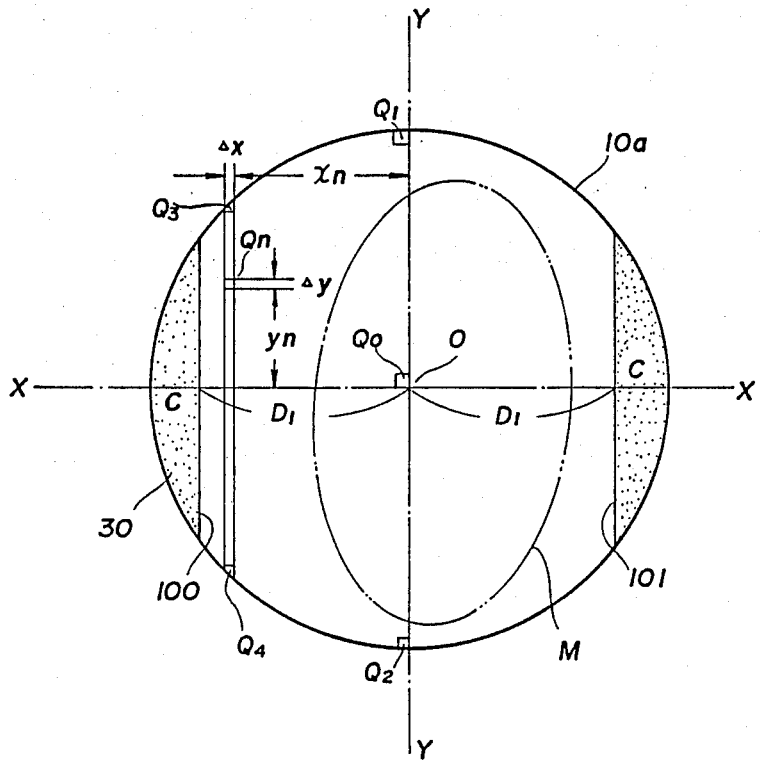
Figure 19:
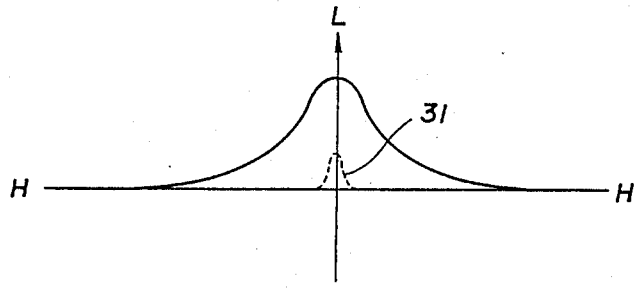

Referring to FIGS. 17 and 18, there is shown a disposition of face elements composing the reflector and the optical characteristic of the reflector in a second embodiment made of an optical system similar to the first embodiment. In this embodiment, the reflecting surface 10*a* of the reflector 10 is divided by the planes 100 ($X=-D_1$) and 101 ($X=D_1$) into a central reflection portion M and marginal reflection portions C, the two planes 100 and 101 are parallel with the plane (Y-Z plane) perpendicular to the meridional image plane a-b of the convex lens 14, including the optical axis, and apart from the optical axis by the distance $D_1$. The orientation of the face element $Q_n$ in the center reflection portion M is decided such that the light from the optical source F is reflected to the point S on the meridional image plane. The orientation of face elements located on the same distance from the plane including the optical axis and in parallel with the meridional image plane substantially are concentrated at the same point on the meridional image plane a-b. For example, the lights reflected on not only the face element $Q_n$ located on $X=-X_n$ but also on the face elements $Q_3$ and $Q_4$ located on the same $X=-X_n$, are concentrated at the same point S ($X=-X_s$) on the meridional image plane. Therefore, the orientation of other face elements in the central reflection portion M is decided by introducing a suitable function for satisfying $X_s=f(X_n)$ by means of the manner as mentioned in the first embodiment. The function f may be selected preferably as a second order linear function such as $X_s=0.125\ X_n^2$. The orientation of each face element in the marginal reflection portions C is decided such that all lights from the optical source are reflected to the point $S_1$ ($X=0$) on the meridional image plane a-b. This means that the marginal reflection portions C compose a portion of the revolutional ellipse surface 30 having a primary focus of the optical source F and a secondary focus of the point $S_1$. The light incident from the light source F to the marginal reflection portions C is reflected in the direction as shown by the arrows A and B to be concentrated at the point $S_1$, and the luminosity distribution due to those light beams is shown by the dotted line 31 in FIG. 19. If a desired luminosity distribution L is as shown by the solid line in FIG. 19, the orientation of each face element in the central reflection portion M of the reflector should be decided such that the luminosity distribution is substracted with the luminosity distribution due to the marginal reflection portions C from the luminosity distribution L. In actual manufacturing, the orientation of the face elements at the vicinity of the center portion is calculated such that the light emitted from the light source F to the vicinity of the center O of the reflector is reflected to the direction as shown by the arrows E and F (i.e. the direction in which the light is directed to the point comparatively shifted from the point $S_1$ at which the optical axis crosses to the meridional image plane a-b). Namely, the orientation of each face element located at the vicinity of the center O of the central reflection portion M should be decided by using a modified function without using the above-mentioned linear function. However, in the case where the formation of the vicinity of the center O is made as similar to that of the first embodiment, the light incident to the vicinity of the center O is reflected to the point comparatively adjacent to the point $S_1$ of the meridional image plane, therefore the luminosity distribution on the shade becomes the distribution that distribution L is added with the luminosity due to the revolutional ellipse surface 30 as shown by the dotted line 31, thereby, increasing the luminosity at the central portion of the shade.

Figure 20:
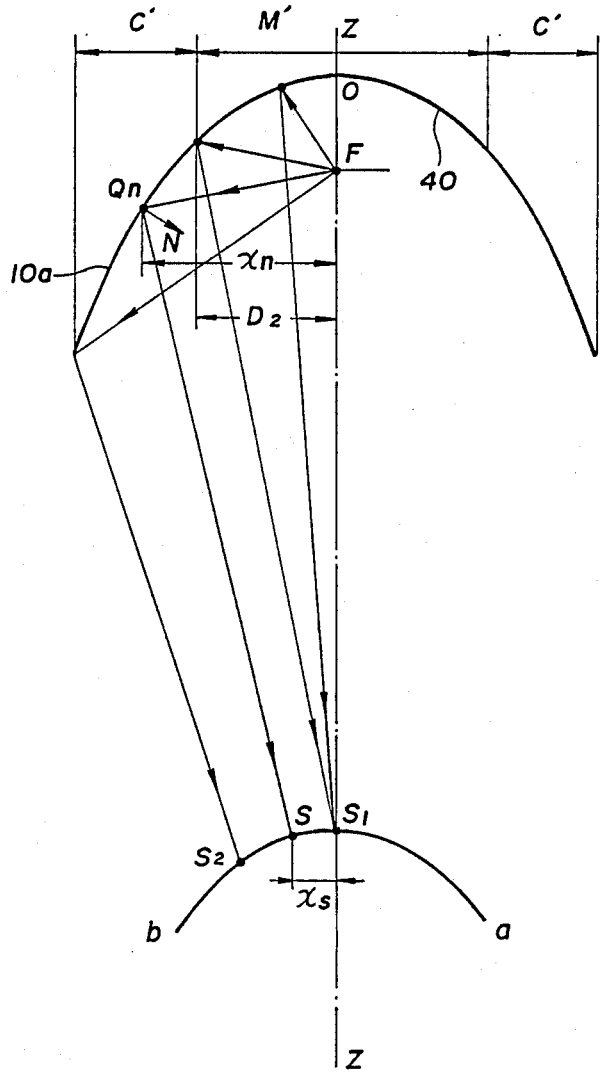
Figure 21:
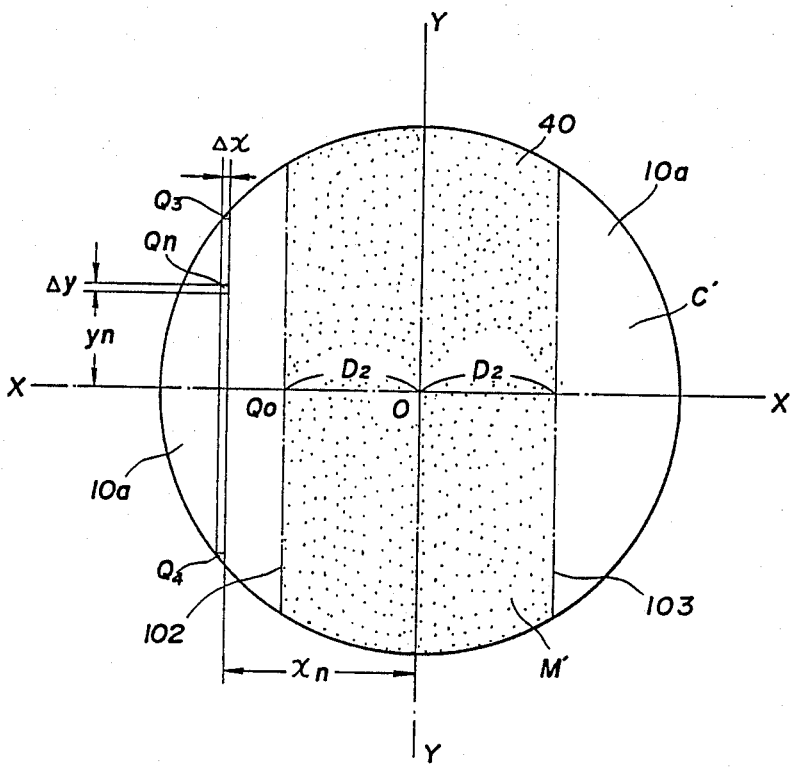

Referring to FIGS. 20 and 21 there are shown the optical characteristic of the reflector and the disposition of each face element in a third embodiment of the present invention, composed of a similar optical system to the first embodiment as mentioned above. In this embodiment, the reflecting surface 10*a* of the reflector 10 is divided into a central reflection portion M' and a marginal reflection portions C' by two planes 102 ($X=-D_2$) and 103 ($X=D_2$) parallel with the plane (Y-Z plane) approximately perpendicular to the meridional image plane a-b of the convex lens and apart from the optical axis by the equidistance $D_2$ respectively. The orientation of each face element of the central reflection portion M' is decided such that all lights incident from the light source are directed to the point $S_1$ ($X=0$) at which the optical axis crosses the meridional image plane a-b. This shows that the face element located in the central reflection portion M' of this embodiment forms approximately a portion of the revolutional ellipse surface having a first focus of the light source F and a second focus point of the point $S_1$, similar to the marginal reflection portion C in the second embodiment. On the other hand, each face element in the marginal reflection portion is decided by introducing the function suitably satisfying the $X_s=f(X_n)$ similar to the face element in the central reflection portion M of the above-mentioned embodiment, and the function such as $X_s=0.125X_n^2$ is selected.

Since the central reflection portion of the reflector is approximately formed by a portion of the revolutional ellipse surface 40, the reflected light is concentrated to the cross point $S_1$ between the optical axis and the meridional image plane a-b thereby increasing the central luminosity distribution with respect to the left and right direction, therefore there is provided some degree of freedom with respect to the setting of the orientation N of each face element $Q_n$ in the marginal reflection portion C' of the reflector 10. Namely, the desired luminosity distribution is obtained in the vicinity of the shade by the central reflection portion M' of the revolutional ellipse surface 40, therefore it is possible to freely control the orientation of each face element $Q_n$ in the marginal reflection portions C' thereby obtaining different luminosity distributions in the vicinity of the shade. Especially, the light incident from the light source F is effectively reflected to the vicinity of the shade by the marginal reflection portions C', therefore the light is utilized effectively.

Figure 22:
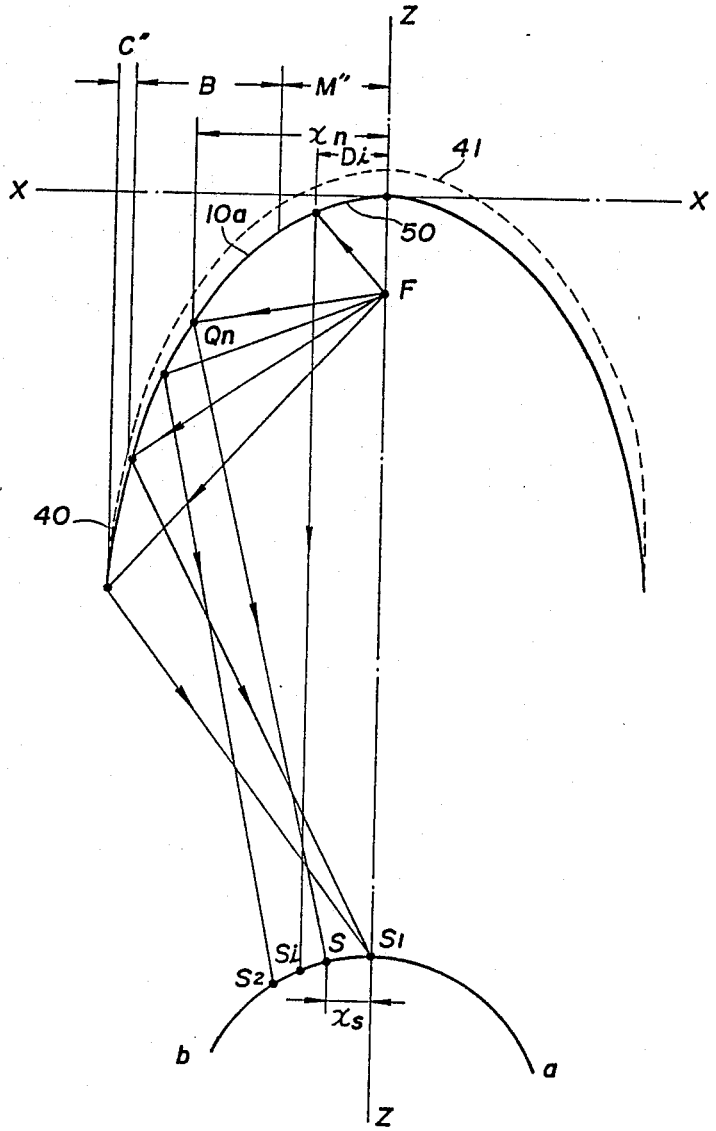
Figure 23:
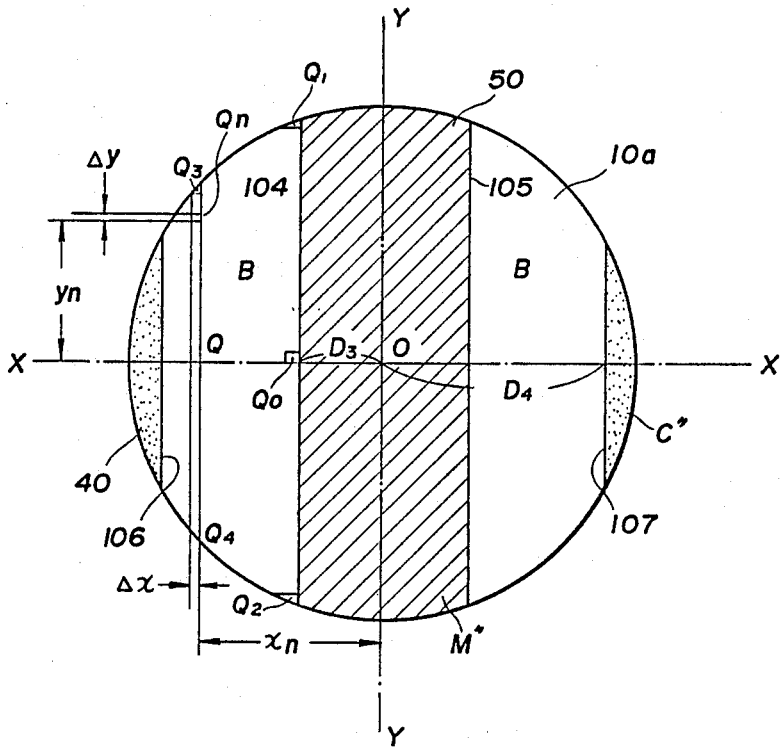

Referring to FIGS. 22 and 23 there are shown the optical characteristics of the reflection and the distribution of each face element in a fourth embodiment of the present invention, composed of a similar optical system to the first embodiment as mentioned above. The reflecting surface 10*a* of the reflector is composed of a central reflection portion M'', two intermediate reflecting portions B adjacent to the central reflection portion M'', two marginal reflection portions C'' adjacent to the intermediate reflecting portions B respectively. The central reflection portion M'' and the intermediate reflecting portions B are divided by two planes 104 ($X=-D_3$) and 105 ($X=D_3$) which are parallel to the plane including the optical axis and perpendicular to the meridional image plane a-b and are apart from the optical axis by the same distance. The intermediate reflecting portions B and the marginal reflection portions C' are divided by two planes 106 ($X=-D_4$) and 107 ($X=D_4$) respectively.

The curved surface 50 of the central reflection portion M'' is formed in a horizontal section as a portion of a parabola having a focus F of the light source F, and is formed in a vertical section as a portion of an ellipse having a first focus of the light source F and a second focus on the meridional image plane. Namely, this is the same as the orientation of the face element decided by applying a first order linear function expressed $X_s=X_n$ ($-D_3<X_n\leqq D_3$).

The curved surface 50 is formed such that all of the lights incident from the light source F on the portions having the distance Di ($O\leqq Di\leqq D_3$) from the Y-Z plane, are reflected to the direction parallel with the Y-Z plane and concentrated at the common point Si having a distance from the optical axis on the meridional image plane. Therefore, there is provided a distribution pattern such that the light is distributed to the wider extent of the peripheral portion of the shade 16.

The orientation of each face element in the marginal reflection portions C'' is decided such that the light incident from the light source F is concentrated to the cross point $S_1$ of the meridional image plane. Such face elements are approximately formed as a portion of the revolutional ellipse surface 40 having the first focus of the light source F and the second focus of the point $S_1$. Namely, it is featured with $X_s=0$ ($X_n\leqq -D_4$ or $X_n\geqq D_4$).

Furthermore, the orientation of each face element in the intermediate reflecting portions B is decided in view of a contribution to the desired luminosity distribution due to the reflected lights in the central reflection portion M'' and marginal reflection portions C''.

The $X_s$ in the case where $-D_4<X_n<-D_3$ or $D_3<X_n<D_4$ is expressed as $X_s=f(X_n)$, and there is selected a function for giving the orientation of each face element $Q_n$ so as to obtain the luminosity in which the contribution due to the light reflected on the revolutional ellipse surface 40 and the contribution due to the light reflected on the curved surface 50 are subtracted from the luminosity distribution on the shade.

In the embodiment, the curved surface 50 is formed such that the central reflection portion M'' is, in a horizontal section, a portion of a parabola having a focus of the light source F, and in a vertical section, a portion of an ellipse having a first focus of the light source F and a second focus of the point of marginal reflection portion. The curved surface 50 is formed so as to at least have a parabola in the horizontal section, and it is not necessary to have a parabola in the vertical section. The reflecting surface in the conventional case where the reflecting surface is formed by only a revolutional ellipse surface, is shown by the dotted line 41 in FIG. 22. The thickness of the reflector in the direction of the optical axis is reduced by the reflecting surface of this embodiment.

In each embodiment mentioned above, as shown in FIGS. 14 and 15 the light reflected at each face element of the reflector provides a distribution pattern having a light shade boundary 19 formed by the edges 15 and 18 of the shade 16, and a portion of the reflected light to be concentrated to the maximum luminosity region 100 is blocked by the shade 16 because the edge 15 of the shade 16 is located on the horizontal plane including the optical axis.

Figure 24:
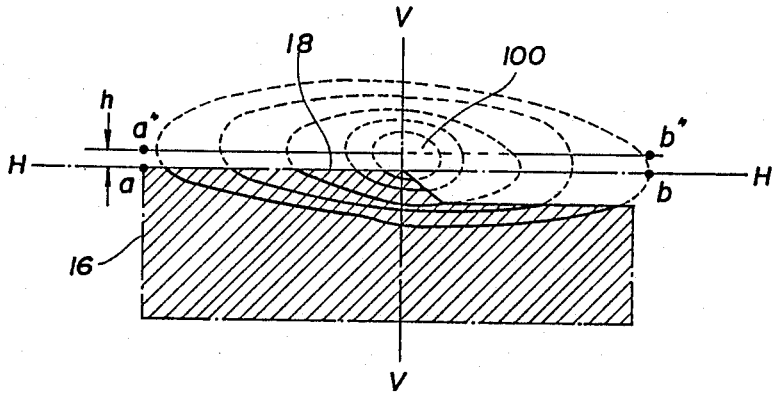
Figure 25:
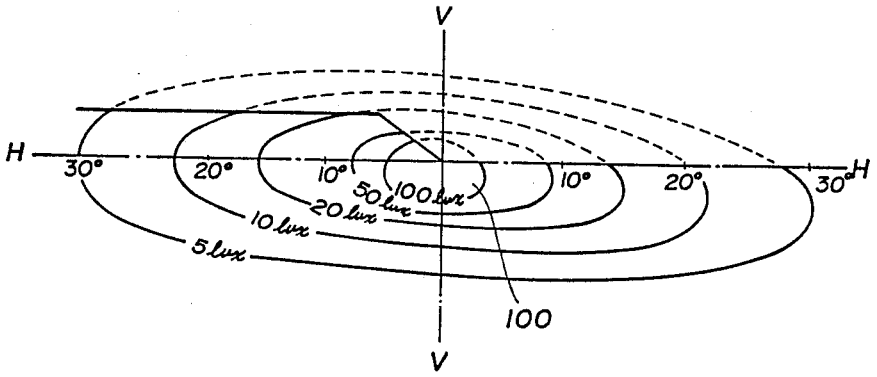

In order not to lose the reflected light to be concentrated to the maximum luminosity region by using the optical system similar to that of the first embodiment, it is necessary that the orientation of each of face elements composing the reflecting surface is decided such that the center of the maximum luminosity region 100 is formed above the edge 15 of the shade 16. FIG. 24 shows a schematic distribution pattern on the position of the shade 16 as mentioned above. There is disposed an optical system that the light source F is disposed on the axis of the reflector, the optical axis of the convex lens 14 is coincident with the axis of the reflector, and further the edge 15 of the shade 16 is disposed along the meridional image plane a-b. A halogen bulb of H3 12V/55W of EC standard is used for the light source F, and the halogen bulb has a filanent of 5.5mm in length and 0.8mm in diameter. In the case where the distance betwen the center of the light source F to the center O of the reflector of the first embodiment is 15mm, and the distance betwen the light source F to the cross point $S_1$ between the optical axis and the meridional image plane is 50mm, it is recognized that the distance h between the center of the maximum luminosity region 100 in the position of the shade 16 to the edge 15 of the shade 16, is about 2mm. Specifically, the orientation of each face element is decided such that the light incident from the light source F is directed to the point on the curve a″-b″ of the meridional image plane located above the curve a-b of the meridional image plane by about 2mm. The distribution pattern at the position apart from the light source F by 10mm is as shown in FIG. 25, and the proportion that the maximum luminosity region 100 is blocked by the shade 16 is reduced thereby effectively utilizing the light emitted from the light source F. With respect to the above mentioned h the above effects are recognized within the region of $0.5\text{mm} \leqq h \leqq 5\text{mm}$, however no effect is obtained in the region of $h < 0.5\text{mm}$ and $h > 5\text{mm}$ in actual fact.

In the embodiment of the headlamp for vehicles of the present invention as mentioned above, the wording "vicinity of the meridional image plane of a convex lens" means the region including the meridional image plane per se and the sagittal image plane of the convex lens substantially. Furthermore, a halogen bulb having a filament is used as a light source in the above embodiment, however a discharge lamp may be used.

What is claimed is:

1. A projector type headlamp for vehicles comprising a reflecting mirror formed in a dish-like shape and having an inner surface as a reflecting surface, a light source an optical axis of which is coincident with the axis of said reflecting mirror, a shade having an edge optically effective for blocking a light-dark boundary by blocking a portion of the light emitted from said light source and reflected by said reflecting surface, and a convex lens disposed within the passage of light beams formed by said shade, the edge of said shade being disposed at the vicinity of the meridional image plane of said convex lens, said reflecting surface being formed of a great many minute face elements smoothly connected with each other, and each of said face elements having an orientation with respect to said optical axis being decided in such a manner that the light incident from said light source is reflected to the vicinity of said meridional image plane and further a desired luminosity distribution can be obtained at the position of said shade.

2. A projector type headlamp for vehicles comprising a reflecting mirror formed in a dish-like shape and having an inner surface as a reflecting surface, a light source an optical axis of which is coincident with the axis of said reflecting mirror, a shade having an edge optically effective for blocking a light-dark boundary by blocking a portion of the light emitted from said light source and reflected by said reflecting surface, and a convex lens disposed within the passage of light beams formed by said shade, the edge of said shade being disposed at the vicinity of the meridional image plane of said convex lens, said reflecting surface being formed of a great many minute face elements smoothly connected with each other, and each of said face elements having an orientation with respect to said optical axis being decided in such a manner that the light incident from said light source is reflected to the vicinity of said meridional image plane and further a desired luminosity distribution can be obtained at the position of said shade, said reflecting surface is composed of a plurality of many face element groups disposed at both sides of a vertical plane including said optical axis with a predetermined distance, said face element group being composed of many face elements located equidistant from said vertical plane, the orientation of each face element of said face element group being decided such that the light from said light source is concentrated to a point in the vicinity of said meridional image plane of said lens, and a distance ($X_s$) between said optical axis and points corresponding to said face element groups being given as a function of a distance ($X_n$) between each of said face element groups and said vertical plane.

3. A projector type headlamp for vehicles according to claim 2, wherein said orientation of each of said face elements is decided such that the light incident from said light source is reflected to the vicinity of said meridional image plane to form a maximum luminosity region above the edge of said shade.

4. A projector type headlamp for vehicles according to claim 3, wherein said orientation of each of said face elements is decided such that the light incident from said light source is reflected to a cross line defined by a horizontal surface which is located above and is parallel with said horizontal surface including the optical axis and said meridional image plane, to form said maximum luminosity region above the edge of said shade.

5. A projector type headlamp for vehicles according to claim 2, wherein said reflecting surface is divided into a central reflection portion and marginal reflection portions by two planes parallel with a plane including said optical axis vertical to said meridional image plane and spaced apart from each other and spaced from said optical axis by a predetermined distance, the orientation of each face element in said central reflection portion being decided to be $X_s=0$ and the orientation of each face element in said marginal reflection portions being decided such that $X_s$ is expressed by a linear equation $X_n$.

6. A projector type headlamp for vehicles according to claim 2, wherein said reflecting surface is divided into a central reflection portion and marginal reflection portions by two planes parallel with a plane including said optical axis vertical to said meridional image plane and spaced apart from each other and spaced from said optical axis by a predetermined distance, the orientation of each face element of said central reflection portion being decided such that $X_s$ is expressed by a linear equation of $X_n$, and the orientation of each face element in said marginal reflection portions being decided to be $X_s=0$.

7. A projector type headlamp for vehicles according to claim 2, wherein said reflecting surface is divided into a central reflection portion, intermediate reflection portions and marginal reflection portions by two planes parallel with a plane including said optical plane and vertical to said meridional image plane and spaced apart from each other and spaced from said optical axis by a predetermined distance, and further by two other planes parallel with said vertical plane and spaced apart from each other and spaced from said optical axis by a distance larger than said predetermined distance, the orientation of each face element in said central reflection portion being decided to be $X_s=X_n$, the orientation of each face element in said intermediate reflection portions being decided such that $X_s$ is expressed by a linear equation of $X_n$, and the orientation of each face element in said marginal reflection portions being decided to be $X_s=0$.

8. A projector type headlamp for vehicles according to claim 1, wherein said reflecting surface is composed of a plurality of many face element groups disposed at both sides of a vertical plane including said optical axis with a predetermined distance, said face element group being composed of many face elements located equidistant from said vertical plane, the orientation of each face element of said face element group being decided such that the light from said light source is concentrated to a point in the vicinity of said meridional image plane of said lens, and a distance $X_s$ between said optical axis and points corresponding to said face element groups being given as a function of a distance $X_n$ between each of said face element groups and said vertical plane.

9. A projector type headlamp for vehicles according to claim 1, wherein said orientation of each of said face elements is decided such that the light incident from said light source is reflected to the vicinity of said meridional image plane to form a maximum luminosity region above the edge of said shade.

10. A projector type headlamp for vehicles according to claim 9, wherein said orientation of each of said face elements is decided such that the light incident from said light source is reflected to a cross line defined by a horizontal surface which is located above and is parallel with said horizontal surface including the optical axis and said meridional image plane, to form said maximum luminosity region above the edge of said shade.

11. A projector type headlamp for vehicles according to claim 8, wherein said reflecting surface is divided into a central reflection portion and marginal reflection portions by two planes parallel with a plane including said optical axis to said meridional image plane and spaced apart from each other and spaced from said optical axis by a predetermined distance, the orientation of each face element in said central reflection portion being decided to be $X_s=0$ and the orientation of each face element in said marginal reflection portions being decided such that $X_s$ is expressed by a linear equation of $X_n$.

12. A projector type headlamp for vehicles according to claim 8, wherein said reflecting surface is divided into a central reflection portion and marginal reflection portions by two planes parallel with a plane including said optical axis and to said meridional image plane and spaced apart from each other and spaced from said optical axis by a predetermined distance, the orientation of each face element of said central reflection portion being decided such that $X_s$ is expressed by a linear equation of $X_n$, and the orientation of each face element in said marginal reflection portions being decided to be $X_s=0$.

13. A projector type headlamp for vehicles according to claim 8, wherein said reflecting surface is divided into a central reflection portion, intermediate reflection portions and marginal reflection portions by two planes parallel with a plane including said optical plane and vertical to said meridional image plane and spaced apart from each other and spaced from said optical axis by a predetermined distance, and further by two other planes parallel with said vertical plane and spaced apart from each other and spaced from said optical axis by a distance larger than said predetermined distance, the orientation of each face element in said central reflection portion being decided to be $X_s=X_n$, the orientation of each face element in said intermediate reflection portions being decided such that $X_s$ is expressed by a linear equation of $X_n$, and the orientation of each face element in said marginal reflection portions being decided to be $X_s=0$.

14. A projector type headlamp for vehicles comprising:

a reflecting mirror formed in a dish-like shape and having an inner surface as a reflecting surface formed of a great many minute face elements smoothly connected with each other;

a light source having an optical axis of which is axially coincident with said reflecting mirror; and a convex lens having a meridional image plane and disposed within a passage of light beams reflected on said reflecting surface, said reflecting surface being composed of a plurality of many face element groups at both sides of a vertical plane including said optical axis with a predetermined distance, said face element groups being composed of many face elements located equidistant from said vertical plane, each face element of each face element group having an orientation being decided such that the light from said light source is concentrated to a point in the vicinity of said meridional image plane of said convex lens, and a distance $X_s$ between said optical axis and points corresponding to said face element groups being given as a function of the distance $X_n$ between each of said face element groups and said vertical plane.

15. A projector type headlamp for vehicles according to claim 1, wherein said shade is formed in a plate and disposed so as to be in contact with the meridional image plane of said convex lens.

* * * * *